US010376126B2

(12) United States Patent
Gao et al.

(10) Patent No.: US 10,376,126 B2
(45) Date of Patent: Aug. 13, 2019

(54) SPRAY ARM ASSEMBLY FOR DISHWASHER, AND DISHWASHER

(71) Applicant: FOSHAN SHUNDE MIDEA WASHING APPLIANCES MFG. CO., LTD., Foshan (CN)

(72) Inventors: Feng Gao, Foshan (CN); Dianling Liu, Foshan (CN)

(73) Assignee: FOSHAN SHUNDE MIDEA WASHING APPLIANCES MFG. CO., LTD., Foshan (CN)

( * ) Notice: Subject to any disclaimer, the term of this patent is extended or adjusted under 35 U.S.C. 154(b) by 0 days.

(21) Appl. No.: 15/554,433

(22) PCT Filed: Nov. 5, 2015

(86) PCT No.: PCT/CN2015/093908
§ 371 (c)(1),
(2) Date: Aug. 30, 2017

(87) PCT Pub. No.: WO2016/138771
PCT Pub. Date: Sep. 9, 2016

(65) Prior Publication Data

US 2018/0049617 A1 Feb. 22, 2018

(30) Foreign Application Priority Data

Mar. 2, 2015 (CN) ..... 2015 1 0093370
Mar. 2, 2015 (CN) ..... 2015 2 0122164 U

(51) Int. Cl.
*A47L 15/23* (2006.01)
*A47L 15/42* (2006.01)

(52) U.S. Cl.
CPC ..... *A47L 15/23* (2013.01); *A47L 15/4282* (2013.01)

(58) Field of Classification Search
CPC ..... A47L 15/18; A47L 15/20; A47L 15/22; A47L 15/23; A47L 15/4278;
(Continued)

(56) References Cited

U.S. PATENT DOCUMENTS 3,361,361 A 1/1968 Schutte
4,175,575 A * 11/1979 Cushing ..... B05B 3/06 134/176

(Continued)

FOREIGN PATENT DOCUMENTS

CN 101095608 A 1/2008
CN 202821259 U 3/2013

(Continued)

OTHER PUBLICATIONS

Machine Translation of Nakagawa, JP-08173368-A, Jul. 1996. (Year: 1996).*

(Continued)

*Primary Examiner* — David G Cormier
(74) *Attorney, Agent, or Firm* — Kilpatrick Townsend & Stockton LLP

(57) ABSTRACT

A spray arm assembly for a dishwasher, and the dishwasher are provided. The spray arm assembly includes: a spray arm base (10); a first bevel gear (20); a spray arm provided with a central water-inlet pipe (301); and a water baffling member (40). The first bevel gear (20) is connected onto the spray arm base (10) in a sleeving way. The central water-inlet pipe (301) penetrates through the first bevel gear (20). Spray apertures (302) are formed in the spray arm. A first end of the water baffling member (40) is disposed at one end of the spray arm, and a second end of the water baffling member (40) is provided with a second bevel gear (401). The water baffling member (40) is opposite to at least one of the spray apertures (302).

8 Claims, 6 Drawing Sheets

(58) Field of Classification Search
CPC ..... A47L 15/428; A47L 15/4282; B05B 1/26; B05B 3/00; B05B 3/022
See application file for complete search history.

(56) References Cited

U.S. PATENT DOCUMENTS

| | | | | | |
|---|---|---|---|---|---|
| 4,509,687 | A | * | 4/1985 | Cushing | A47L 15/23 134/179 |
| 2012/0279530 | A1 | | 11/2012 | Thiyagarajan | |

FOREIGN PATENT DOCUMENTS

| | | | | |
|---|---|---|---|---|
| CN | 103908205 | A | | 7/2014 |
| CN | 203987928 | U | | 12/2014 |
| CN | 204049578 | U | | 12/2014 |
| CN | 204158346 | U | | 2/2015 |
| CN | 104545745 | A | | 4/2015 |
| CN | 104644097 | A | | 5/2015 |
| CN | 104706293 | A | | 6/2015 |
| CN | 204427969 | U | | 7/2015 |
| CN | 204467993 | U | | 7/2015 |
| CN | 204581195 | U | | 8/2015 |
| DE | 102005026558 | B3 | | 11/2006 |
| JP | 08173368 | A | * | 7/1996 |
| KR | 20130011337 | A | | 1/2013 |

OTHER PUBLICATIONS

CN Office Action dated Dec. 15, 2016 in the Chinese priority application (Application No. 201510093370.9).
European Office Action dated Dec. 12, 2018 in the corresponding EP application (application No. 15883821.9).

* cited by examiner

SPRAY ARM ASSEMBLY FOR DISHWASHER, AND DISHWASHER

CROSS-REFERENCE TO RELATED APPLICATION

This application is a national phase entry under 35 USC § 371 of International Application PCT/CN2015/093908, filed Nov. 5, 2015, which claims priority to and benefits of Chinese Patent Applications Serial No. 201510093370.9 and 201520122164.1, both filed with the State Intellectual Property Office of P. R. China on Mar. 2, 2015, the entire contents of which are incorporated herein by reference.

FIELD

The present disclosure relates to a technical field of household appliances, and more particularly to a spray arm assembly for a dishwasher and a dishwasher having the same.

BACKGROUND

In the related art, a dishwasher has a spray arm with a series of spray apertures, high pressure water sprayed from the spray apertures can flush dishes to clean the dishes. In order to reduce water consumption, there are a limited number of spray apertures, and each spray aperture can only spray water to one direction, resulting in a limited spraying area of the whole spray arm, and a lot of areas cannot be directly flushed, which means in order to achieve a cleaning effect, a long washing time is needed, reflection of a water flow and probability of reflection need improving. The spray arm of the dishwasher in the related art consumes a long washing time and has dead areas where dishes cannot be cleaned during the washing.

SUMMARY

Embodiments of the present disclosure seek to solve at least one of the problems existing in the related art to at least some extent. The present disclosure provides a spray arm assembly for a dishwasher, and the spray arm assembly can change a water spraying angle and expand a spraying area.

The present disclosure further provides a dishwasher having the above spray arm assembly.

The spray arm assembly according to embodiments of the present disclosure includes a spray arm base; a first bevel gear, fixedly fitted over an upper end of the spray arm base; a spray arm, provided with a central water-inlet conduit and defining a plurality of spray apertures, the central water-inlet conduit passing through the first bevel gear to be inserted downwards into the spray arm base; and a water baffling member, having a first end rotatably arranged to an end of the spray arm and a second end provided with a second bevel gear engaged with the first bevel gear, the water baffling member corresponding to at least one of the plurality of spray apertures.

With the spray arm assembly according to the embodiments of the present disclosure, during a working process, the spray arm rotates above the spray arm base, the second bevel gear of the water baffling member rotates along the first bevel gear to drive the water baffling member to rotate, which can change angles of water sprayed through the spraying apertures, thus expanding a spraying area.

In addition, a door body of a refrigerator according to the present disclosure also has the following additional technical features.

According to an embodiment of the present disclosure, a locking member is provided to an outer circumferential surface of an upper end of the spray arm base, and an inner circumferential surface of the first bevel gear defines a locking groove fitted with the locking member. Thus, the spray arm base can be connected to the first bevel gear through cooperation between the locking member and the locking groove.

According to an embodiment of the present disclosure, the end of the spray arm is provided with a lug, and the first end of the water baffling member is rotatably arranged to the lug; the spray arm has a pivot adjacent to the central water-inlet conduit and corresponding to the lug, and the second bevel gear is fitted over the pivot. During the working process, the spray arm can rotate above the spray arm base.

According to an embodiment of the present disclosure, the plurality of spray apertures are spaced apart along a length direction of the spray arm, and the water baffling member corresponds to the plurality of spray apertures. Therefore, water sprayed out from the spray arm can be increased, thus raising a cleaning efficiency of dishes.

According to an embodiment of the present disclosure, the water baffling member has a water baffling sheet. Thus, water can be reflected to different directions by means of the water baffling sheet, thereby improving a cleaning effect of dishes.

According to an embodiment of the present disclosure, a plurality of water baffling sheets are provided and are uniformly spaced apart along a circumferential direction of the water baffling member. As a result, the water baffling member can be subject to uniform forces while the cleaning efficiency is ensured.

According to an embodiment of the present disclosure, the water baffling sheet has an arc or polygonal cross section, to diversify angle changes of spraying water.

A dishwasher according to the embodiments of the present disclosure includes the spray arm assembly according to any one of the above embodiments.

The dishwasher according to the embodiments of the present disclosure can change angles of water sprayed out through spray apertures by means of the spray arm assembly according to the above embodiments, thus improving the cleaning effect of dishes and satisfying consumer needs better.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other additional aspects and advantages of embodiments of the present disclosure will become apparent and more readily appreciated from the following descriptions made with reference to the drawings, in which.

Figure 1:
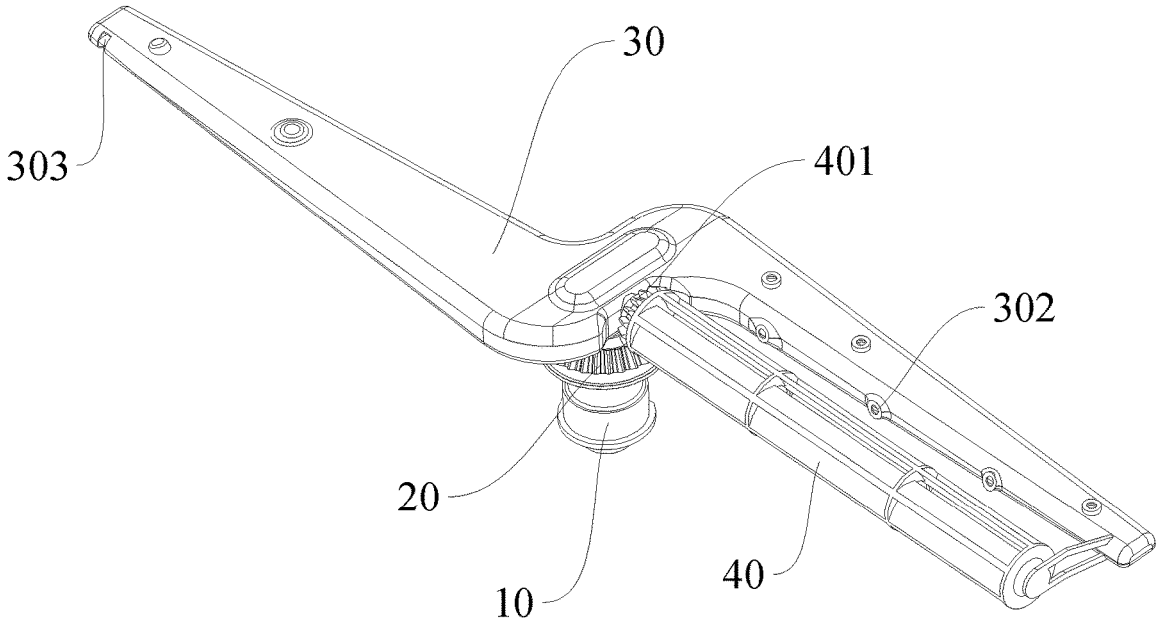
FIG. 1 is a schematic view of a spray arm assembly for a dishwasher according to an embodiment of the present disclosure.

REFERENCE NUMERAL spray arm base 10, first bevel gear 20, spray arm 30, water baffling member 40, locking member 101, central water-inlet conduit 301, spray aperture 302, driving spray aperture 303, second bevel gear 401, lug 304, pivot 305, water baffling sheet 402.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, unless specified or limited otherwise, relative terms such as "central", "longitudinal", "upper", "lower", "front", "rear", "left", "right", "vertical", "horizontal", "top", "bottom", "inner", "outer", as well as derivative thereof should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, the term "a plurality of" means two or more than two, unless specified otherwise.

In the present invention, unless specified or limited otherwise, the terms "mounted," "connected," "coupled," are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

With reference to drawings, a spray arm assembly for a dishwasher according to embodiments of the present disclosure will be described in detail.

Figure 2:
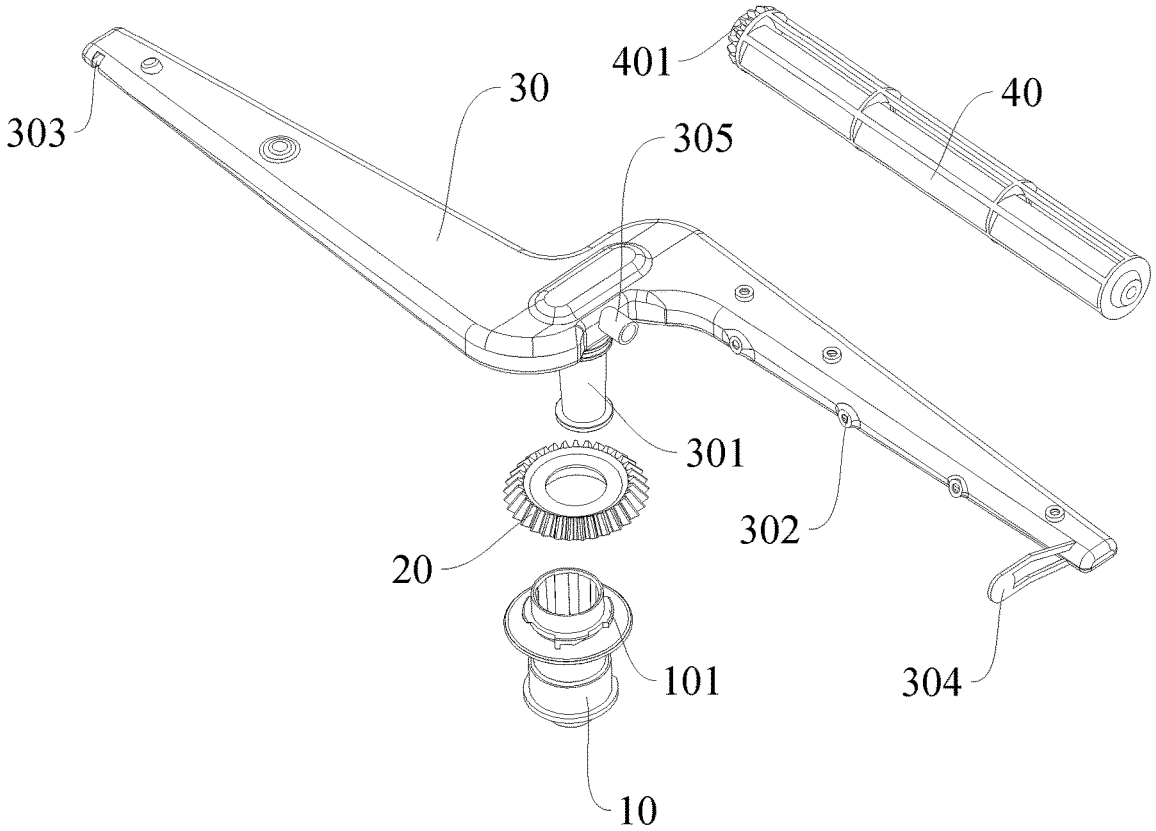
FIG. 2 is a schematic view of a spray arm assembly for a dishwasher according to another embodiment of the present disclosure.
Figure 3:
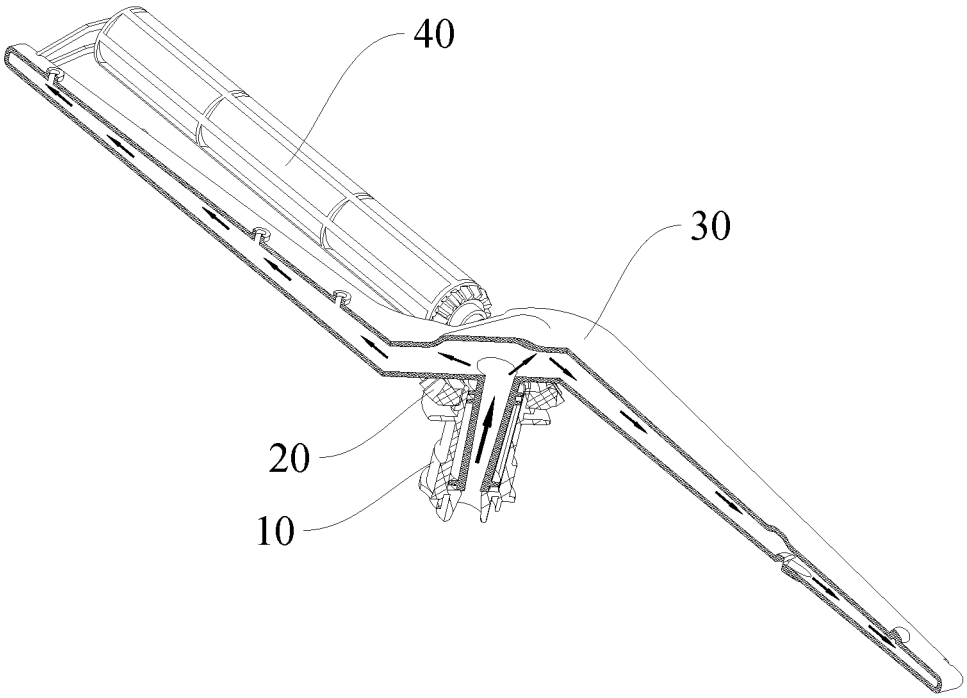
FIG. 3 is a schematic view of a spray arm assembly for a dishwasher according to still another embodiment of the present disclosure.
Figure 4:
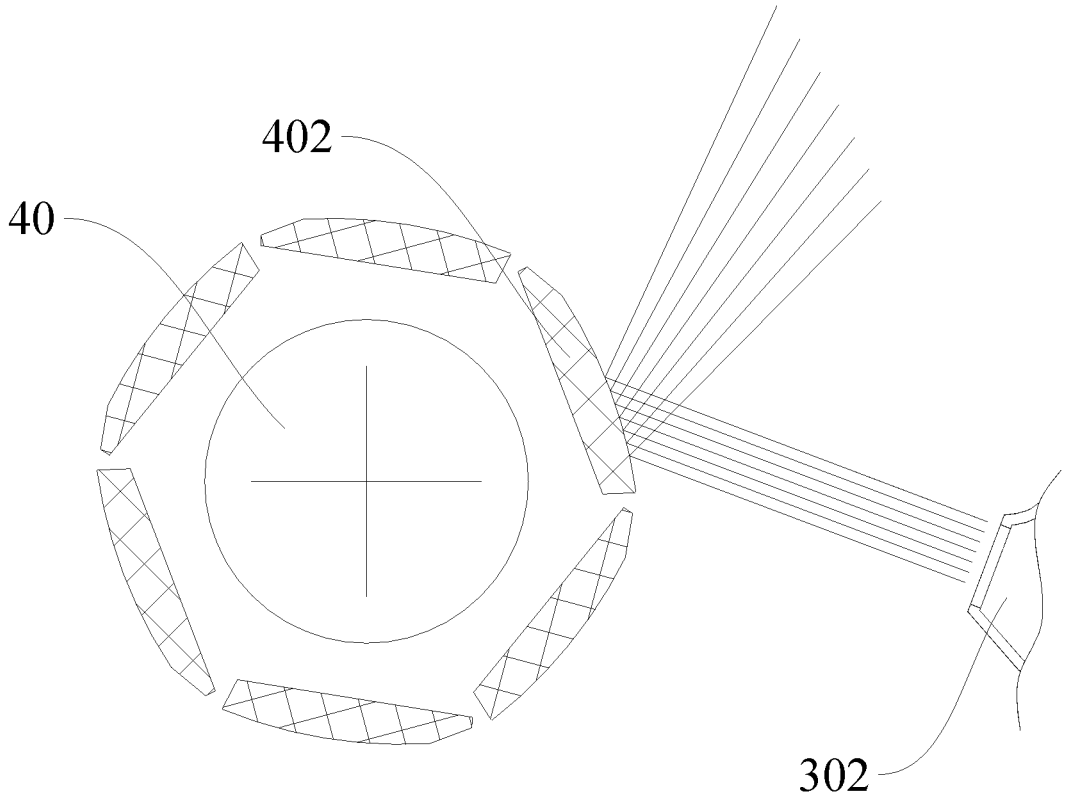
FIG. 4 is a first view illustrating that a spray arm assembly for a dishwasher according to an embodiment of the present disclosure changes an angle of spraying water.
Figure 5:
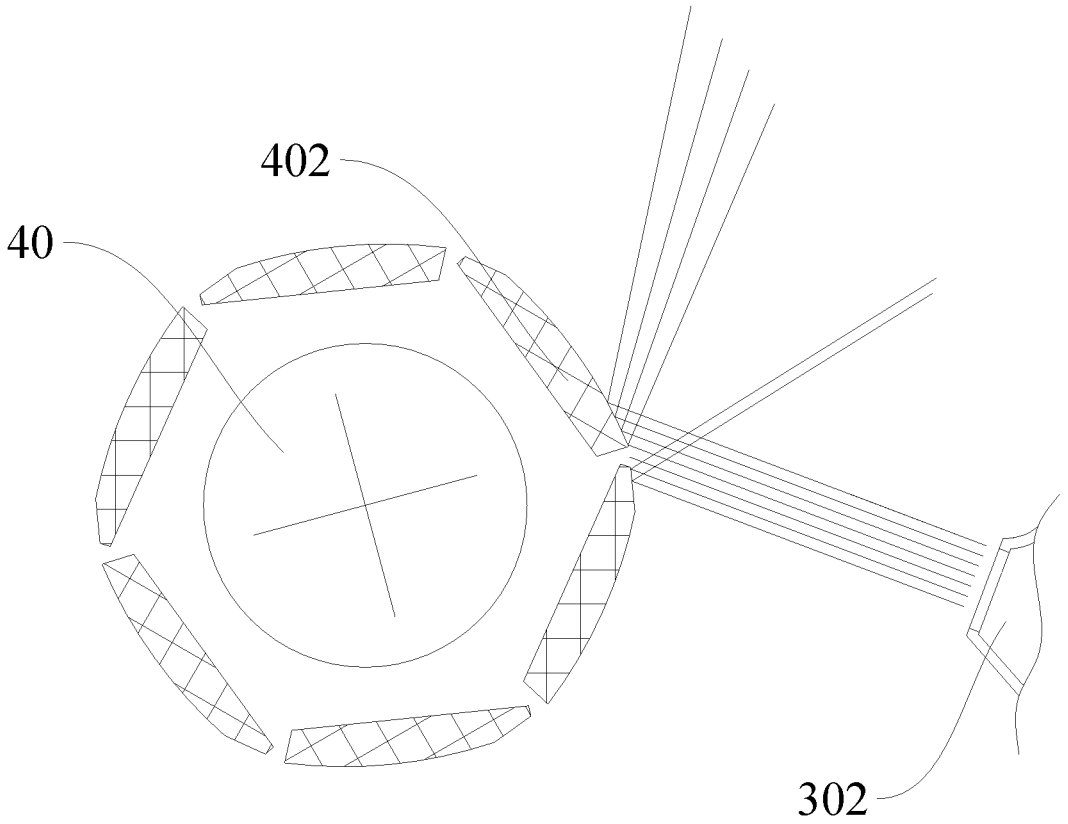
FIG. 5 is a second view illustrating that a spray arm assembly for a dishwasher according to an embodiment of the present disclosure changes an angle of spraying water.
Figure 6:
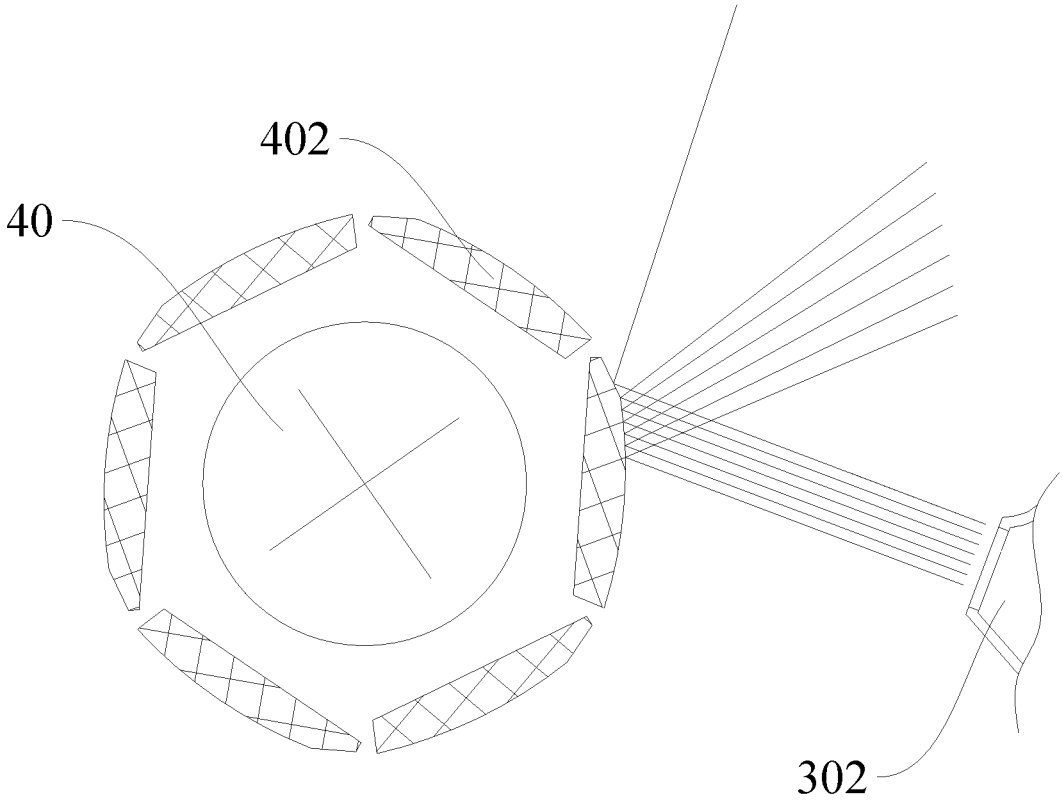
FIG. 6 is a third view illustrating that a spray arm assembly for a dishwasher according to an embodiment of the present disclosure changes an angle of spraying water.

As illustrated in FIG. 1 to FIG. 6, the spray arm assembly according to the embodiments of the present disclosure includes a spray arm base 10, a first bevel gear 20, a spray arm 30 and a water baffling member 40.

Specifically, the first bevel gear 20 is fixedly fitted over an upper end of the spray arm base 10. For example, a locking member 101 is provided to an outer circumferential surface of the upper end of the spray arm base 10, an inner circumferential surface of the first bevel gear 20 defines a locking groove (not shown) fitted with the locking member 101, and the spray arm base is fixedly connected to the first bevel gear through the locking member and the locking groove. Also, the spray arm base can be connected to the first bevel gear through threads, which should be understood by those skilled in the art.

The spray arm 30 is provided with a central water-inlet conduit 301. The central water-inlet conduit 301 passes through the first bevel gear 20 to be inserted downwards into the spray arm base 10. The spray arm 30 defines a plurality of spray apertures 302. It should be understood that, the spray arm 30 further defines a driving spray aperture 303 configured to provide power for rotation of the spray arm 30.

The water baffling member 40 has a first end rotatably arranged to an end of the spray arm 30, and a second end provided with a second bevel gear 401 engaged with the first bevel gear 20. The water baffling member 40 corresponds to at least one of the plurality of spray apertures 302. Advantageously, the plurality of spray apertures 302 are spaced apart along a length direction of the spray arm 30, and the water baffling member 40 corresponds to the plurality of spray apertures 302.

As illustrated in FIG. 3 to FIG. 6, during the rotation of the spray arm 30, the water baffling member 40 rotates on the spray arm 30 through rotation of the first bevel gear 20 and the second bevel gear 401, and water sprayed through the spray apertures 302 is reflected to different areas along with continuous rotation of the water baffling member 40. Water are scattered and directions of water are greatly expanded.

With the spray arm assembly according to the embodiments of the present disclosure, during a working process, the spray arm rotates above the spray arm base, the second bevel gear of the water baffling member rotates along the first bevel gear to drive the water baffling member to rotate, which can change angles of water sprayed through the spraying apertures, thus expanding a spraying area.

According to an embodiment of the present disclosure, the end of the spray arm 30 is provided with a lug 304, and the first end of the water baffling member 40 is rotatably arranged to the lug 304. The spray arm 30 has a pivot 305 adjacent to the central water-inlet conduit 301 and corresponding to the lug 304, and the second bevel gear 401 is fitted over the pivot 305.

According to an embodiment of the present disclosure, the water baffling member 40 has a water baffling sheet 402. A plurality of water baffling sheets 402 are provided and are uniformly spaced apart along a circumferential direction of the water baffling member 40. The water baffling sheet 40 can have an arc or polygonal cross section, to diversify angle changes of spraying water.

A mounting process of the spray arm assembly according to the embodiments of the present disclosure will be briefly described below.

First, the first bevel gear 20 is fixed on the spray arm base 10, then the central water-inlet conduit 301 passes through the first bevel gear 20, and the spray arm 30 is inserted onto the spray arm base 10. The second bevel gear 401 of the water baffling member 40 is fitted over the pivot 305 and the first end of the water baffling member 40 is connected to the lug 304.

During the working process, high pressure water is pumped out from a washer pump of the dishwasher, enters the spray arm base 10 and then enters the spray arm 30, and the water in the spray arm 30 is sprayed out through all of the spray apertures. The spray arm 30 defines one or a plurality of driving spray apertures 303, and the spray arm 30 rotates under the action of water thrust of the driving spray apertures 303. The first bevel gear 20 is fixed on the spray arm base 10, the second bevel gear 401 mounted to the spray arm 30 cooperates with the first bevel gear 20, and the second bevel gear 401 rotates relative to the first bevel gear 20 during the rotation of the spray arm 30, to drive the water baffling member 40 to rotate on the spray arm 30.

The water baffling member 40 has one or a plurality of water baffling sheets 402, each water baffling sheet 402 has a surface facing the spray apertures 302, and the surface is configured to have an arc shape or a plurality of zigzag segments (that is the water baffling sheet 40 has an arc or polygonal cross section). The spray apertures 302 can be angled to ensure that the water is sprayed to an upper end of the water baffling member. During rotation of the water baffling sheet 402, the water sprayed through the spray apertures 302 are scattered in different directions. With the configuration, water columns sprayed through the spray apertures 302 are dynamically scattered in different directions, greatly expanding the spraying area of the spray apertures 302, increasing an area and probability of the dishes to be directly flushed, further speeding up the washing, avoiding presence of any dead area during the spraying, and improving a cleaning rate of the dishwasher.

Reference throughout this specification to "an embodiment," "some embodiments," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A spray arm assembly for a dishwasher, comprising:

a spray arm base;

a first bevel gear, fixedly fitted over an upper end of the spray arm base;

a spray arm provided with a central water-inlet conduit, the central water-inlet conduit passing through the first bevel gear to be inserted downwards into the spray arm base, wherein the spray arm has at least one spray aperture and at least one driving aperture; and a water baffling member of a cylindrical shape, having a first end rotatably arranged to an end of the spray arm and a second end provided with a second bevel gear engaged with the first bevel gear, the water baffling member corresponding to the at least one spray aperture.

2. The spray arm assembly according to claim 1, wherein a locking member is provided to an outer circumferential surface of an upper end of the spray arm base, and an inner circumferential surface of the first bevel gear defines a locking groove fitted with the locking member.

3. The spray arm assembly according to claim 1, wherein the end of the spray arm is provided with a lug, and the first end of the water baffling member is rotatably arranged to the lug; the spray arm has a pivot adjacent to the central water-inlet conduit and corresponding to the lug, and the second bevel gear is fitted over the pivot.

4. The spray arm assembly according to claim 1, wherein the at least one spray aperture includes plural spray apertures spaced apart along a length direction of the spray arm.

5. The spray arm assembly according to claim 4, wherein the water baffling member has a water baffling sheet.

6. The spray arm assembly according to claim 5, wherein a plurality of water baffling sheets are provided and are uniformly spaced apart along a circumferential direction of the water baffling member.

7. The spray arm assembly according to claim 5, wherein the water baffling sheet has an arc or polygonal cross section.

8. A dishwasher, comprising a spray arm assembly according to claim 1.

* * * * *